US007104802B1

(12) United States Patent
Okumura et al.

(10) Patent No.: US 7,104,802 B1
(45) Date of Patent: Sep. 12, 2006

(54) IC CARD CONNECTOR

(75) Inventors: Shinya Okumura, Shinagawa-ku (JP); Ryo Sasaki, Shinagawa-ku (JP)

(73) Assignee: SMK Corporation, Tokyo ( * ) Notice: Subject to any disclaimer, the term of this patent is extended or adjusted under 35 U.S.C. 154(b) by 0 days.

(21) Appl. No.: 11/251,498

(22) Filed: Oct. 14, 2005

(30) Foreign Application Priority Data

May 13, 2005 (JP) ..... 2005-141747

(51) Int. Cl.
*H01R 24/00* (2006.01)

(52) U.S. Cl. ..... 439/61; 439/630; 439/946

(58) Field of Classification Search ..... 439/59–62, 439/326, 327, 629–630, 637–638, 217, 946
See application file for complete search history.

(56) References Cited

U.S. PATENT DOCUMENTS 7,037,123 B1 * 5/2006 Nakamura et al. ..... 439/152
7,037,125 B1 * 5/2006 Kuan et al. ..... 439/159
7,040,928 B1 * 5/2006 Lai et al. ..... 439/630
7,040,930 B1 * 5/2006 Farnworth et al. ..... 439/632
7,044,796 B1 * 5/2006 Tsai ..... 439/630
7,044,802 B1 * 5/2006 Chiou et al. ..... 439/660

OTHER PUBLICATIONS

Patent Abstracts of Japan for 2003-100369 published on Apr. 4, 2003.

* cited by examiner

*Primary Examiner*—Khiem Nguyen
(74) *Attorney, Agent, or Firm*—Darby & Darby

(57) ABSTRACT

An IC card connector in which in the insertion space for one IC card, the insertion space for the other IC card is secured, and contact parts are disposed near the insertion slot. In the insertion slot for one IC card, the insertion space for the other IC card is disposed, which is narrower in width and one end of the height direction is located in the insertion slot for the one IC card, while at least a part of the insertion space is shared with the insertion space for the one IC card. A plate is disposed to partition the shared part of the insertion space for the one IC card to make the shared part as the insertion space for the other IC card. This plate has a mechanism that, when the one card is inserted while the other card is not, the plate is moved away from the insertion space for the one IC card and makes room therefor.

5 Claims, 5 Drawing Sheets

Prior Art

Prior Art

IC CARD CONNECTOR

INCORPORATION BY REFERENCE

The present application claims priority under 35 U.S.C. §119 to Japanese Patent Application No. 2005-141747 filed on May 13, 2005. The content of the application is incorporated herein by reference in its entirety.

BACKGROUND OF THE INVENTION

The present invention relates to an IC card connector for connecting an IC card which is used as an external memory medium for electronic devices such as a personal computer and the like, wherein a plurality of IC cards in different specifications may be accommodated with the same connector.

A memory medium, a so-called IC card, which is a card type memory device having a built-in semiconductor memory, is widely used as an external memory device for electronic devices such as a computer main unit, video camera apparatus, and a portable information terminal device. Being very small in comparison with conventional memory media but having a large memory, this IC card is a convenient memory medium for transferring data from a digital camera and portable information terminal device to the computer main unit, for printing by transferring data directly to a printer or, conversely, for transferring data from the computer to these electronic devices.

There are a plurality of kinds of IC cards with different sizes and shapes which require individual connectors, and the present applicants have proposed a complex connector which can accommodate a plurality of kinds of IC cards in Japanese Laid Open Patent Publication No. 2003-100369 ("JP '369").

This IC card connector is shown in FIG. 8 and FIG. 9. The IC card connector shown in FIGS. 8 and 9 is composed of a thin box type connector housing 1, in the front of which the first insertion slot 2 and the second insertion slot 3 are disposed in top and bottom levels communicating in a flat reverse T shape, and inside these first and second insertion slot 2, 3, contacts are disposed for first, second, third and fourth IC cards, 27, 28, 31 and 33. Pin terminals connect from these contact to an external substrate.

FIG. 10 through FIG. 13 shows the IC card connector of JP '369 in which corresponding IC cards are inserted. FIG. 10 and FIG. 11 are front views of the IC card connector, in which the first IC card 27 and the second IC card 28 are inserted to the first insertion slot 2. In this case, both cards use the contact 6, which is located toward the middle of the depth axis in the first insertion slot 2 shown in FIG. 9. FIG. 12 shows a front view when the third IC card 31 is inserted to the first insertion slot 2, and, in this case, the contact 7 is used, which is placed further back than the contact 6 described above in the first insertion slot 2 shown in FIG. 9. FIG. 13 shows a front view when the fourth IC card 33 is inserted to the second insertion slot 3, and, in this case, the contact 8 is used, which is placed in the second insertion slot 3 shown in FIG. 9.

Here, the insertion space where the first IC card 27 or the second IC card 28 are inserted shown in FIG. 10 and FIG. 11 and the other insertion space where the third IC card 33 is inserted shown in FIG. 13 are totally independent each other, and practically separate insertion slots. In the IC card connector of JP '369, the first IC card 27 or the second IC card 28 shown in FIG. 10 and FIG. 11 and the third IC card 31 shown in FIG. 12 share the same insertion space, but, in this case, the back part of the space of the insertion slot is formed with the width of the third IC card 31 to be utilized to hold the third IC card 31 which has a narrower width than the first IC card 27, and therefore, it can be said that these are independent spaces for holding different cards.

The method for accommodating a plurality of IC cards in the conventional IC card connectors is, as in the IC card connector shown in JP '369, by making separate independent insertion slots or, in the case where one IC card and the other IC card with a narrower width share the same insertion entry point, by placing the holding mechanism for the latter narrower IC card in the back part of the insertion space for the former IC card (the contact is also placed toward the back). However, no IC card connector is proposed yet in which, at the front side of the insertion space of an IC card, the insertion space for another IC card that is narrower in width and lower in height and a contact part thereof are secured.

OBJECTS AND SUMMARY OF THE INVENTION

The object of the present invention is to overcome the problems described above and to provide an IC card connector in which in the insertion space for one IC card, the insertion space for the other IC card is secured, which is narrower in width and lower in height, and contact parts are disposed near the insertion slot.

The invention provides an IC card connector in which a plurality of types of IC cards are inserted into an insertion slot of a common connector housing so that electrodes of the IC card are connected to contacts in the insertion slot. In an insertion slot for a first IC card is disposed an insertion space for a second IC card that is narrower than the first IC card, one end along a height axis of the second IC card insertion space being positioned in the first IC card insertion slot, and the second IC card insertion space sharing at least a section of the first IC card insertion space. A plate is disposed to partition the shared section with the first IC card as the second IC card insertion space. The plate is equipped with a mechanism for clearing the first IC card insertion space by retracting from the first IC card insertion space when the first IC card is inserted and no second IC card is inserted.

Another embodiment of the invention is an IC card connector where the plate is given restoring force for returning from a position retracted from the first IC card insertion space to a position for partitioning the second IC card insertion space when the first IC card is removed.

A further embodiment of the invention is an IC card connector where the plate is secured to the connector housing by hinges disposed at four positions and can sink while sliding back in an insertion direction, a torsion spring being mounted on at least one of the four hinges so that, when the entire plate sinks down due to insertion of the first IC card, restorative force is stored by the torsion spring, allowing the plate to be restored to an original position partitioning the second IC card insertion space when the first IC card has been removed.

Additionally, in case one needs to secure the insertion space for the other card, which is narrower in width and lower in height, inside of the insertion space for the one IC card, the insertion spaces can be more freely disposed and the scope of designing can be wider than in the conventional design, because the insertion space for the other IC card is partitioned by a plate inside of the insertion space for the one IC card, and at the same time the plate has a mechanism making room for the insertion space for the one IC card by moving away from the insertion space for the one IC card.

According to the invention, when the one IC card is removed from the IC card connector, the plate has a restoring force from the position to which the plate is pushed away to the position where the insertion space for the other IC card is partitioned and thus immediately returns to the original position forming an insertion space for the other IC card, and therefore, the IC card connector is always ready to accommodate the insertion of either of the IC card.

According to another embodiment of the invention, the IC card connector is composed in such a way that when the whole plate is sunk by inserting the one IC card, the force to return to the original position is stored in the torsion spring and that when the one IC card is removed, the plate returns to the original position where the insertion space for the other IC card is partitioned, and therefore, the IC card connector is always ready to accommodate the insertion of either of the IC card.

The above, and other objects, features and advantages of the present invention will become apparent from the following description read in conjunction with the accompanying drawings, in which like reference numerals designate the same elements.

BRIEF DESCRIPTION OF THE DRAWINGS

FIGS. 6(*a*), 6(*b*), 6(*c*) and 6(*d*) are the plan view, front view, left side view with one part in cross-section, and right side view of the first IC card, respectively;

FIGS. 7(*a*), 7(*b*-2), and 7(*c*-2) are the plan view, side view and front view of the third IC card, respectively;

DETAILED DESCRIPTION OF THE EMBODIMENTS

The present invention is an IC card connector in which a plurality of kinds of IC cards are inserted to a common insertion slot of a connector housing so that an electrode of the IC card touches to a contact in the insertion slot, wherein in the insertion slot for one IC card, the insertion space for the other IC card, which is narrower in width and a face of the height direction is located in the insertion slot for the one IC card, is disposed with at least a part of the insertion space is shared with the insertion space for the one IC card, and a plate is disposed to separate the shared part of the insertion space for the one IC card and to make the shared part as the insertion space for the other IC card, and this plate has a mechanism that, when the one card is inserted while the other card is not, the plate is moved away from the insertion space for the one IC card and makes room therefor, and further the plate is designed to sink while sliding backward by fixing the plate with hinges placed in four places on the connector housing, and among the hinges at least a hinge in one location is attached with a torsion spring, so that a restoring force is stored in the torsion spring when the whole plate is sunk, and when the one IC card is removed, the plate is returned to the position where the insertion space for the other IC card is partitioned. Embodiments of the IC card connector of the present invention are explained by FIG. 1–FIG. 7. First, the details of IC cards used in the IC card connector of the present invention are explained using FIG. 6 and FIG. 7. However, the composition of the IC card connector of the present invention is not limited to these 2 kinds of IC cards, these are only examples, and other IC cards may be used.

Figure 6:
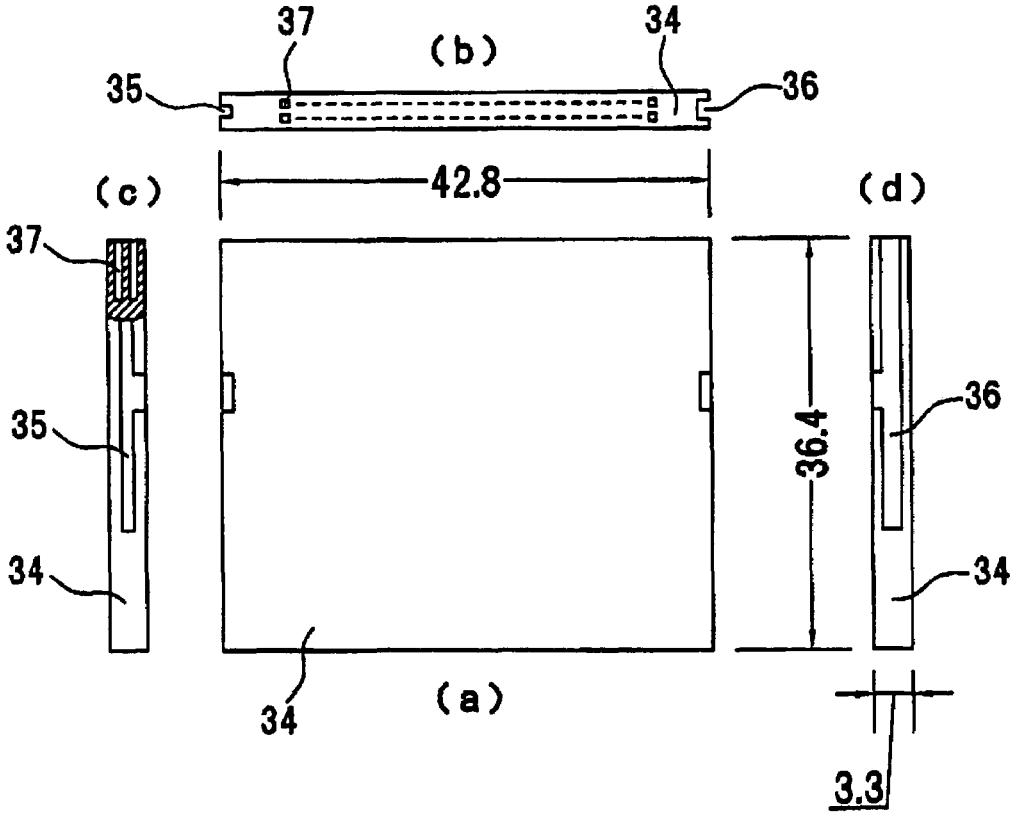
FIG. 6 shows the shape of the first IC card used in the IC card connector of the present invention.

FIG. 6 shows the first IC card 34. It measures 42.8 mm in length and 36.4 mm in width as shown in (a) and 3.3 mm in thickness, and grooves 35, 36 are formed in each side as shown in (c) and (d). Further, as shown in (b), on the tip of the inserting side, disposed are 25×2 total 50 pin terminal insertion holes 37 to which the pin terminals 15 disposed in the housing 10 are inserted.

Figure 7:
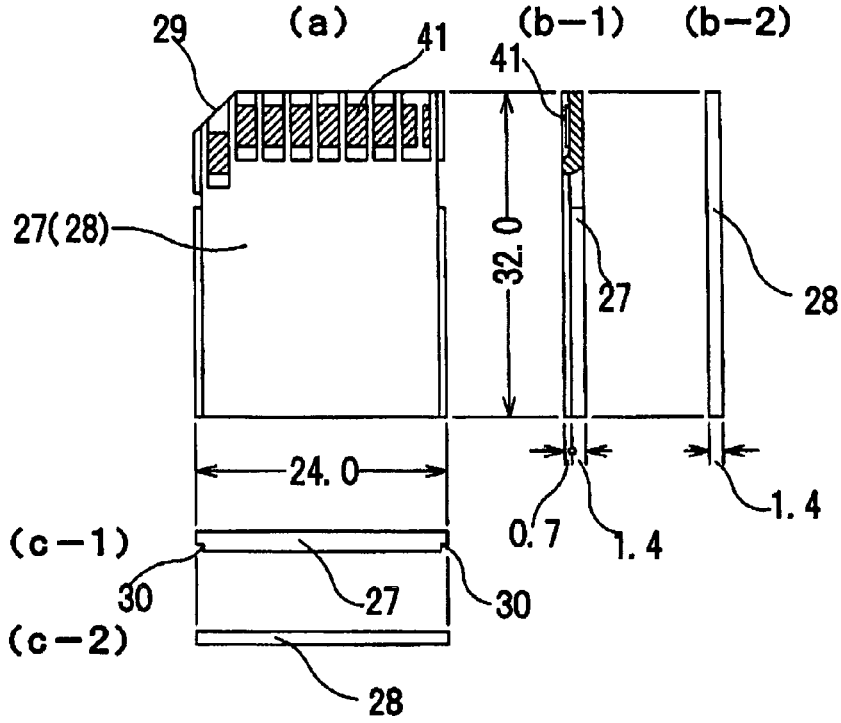
FIG. 7 shows the shape of the second and third IC cards used in the IC card connector of the present invention.
Figure 8:
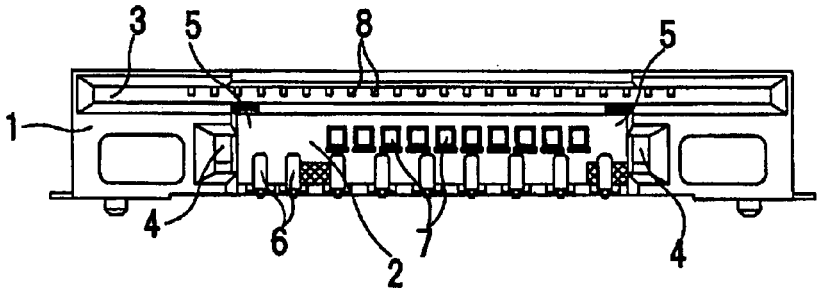
FIG. 8 is a front view of an example of a conventional IC card connector.
Figure 9:
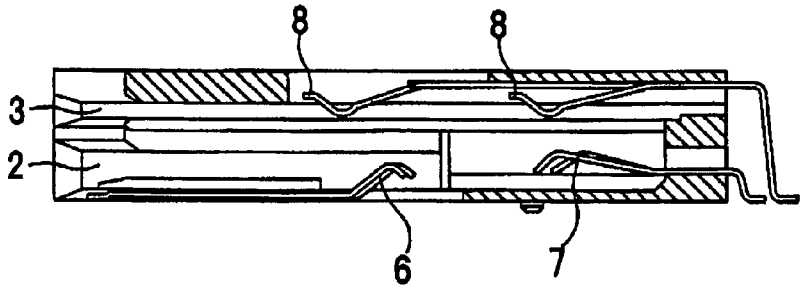
Prior Art FIG. 9
FIG. 9 is a longitudinal section of the conventional IC card connector of FIG. 8.
Figure 10:
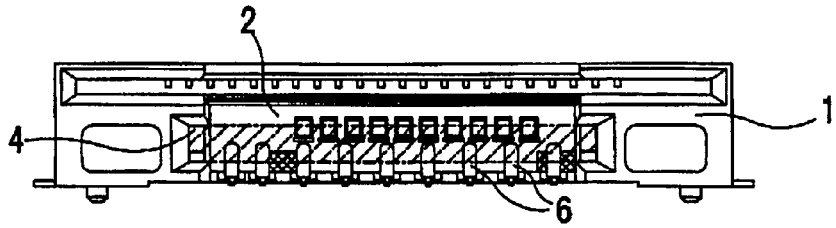
FIG. 10 is a front view of the conventional IC card connector of FIG. 8 showing the first IC card inserted.
Figure 11:
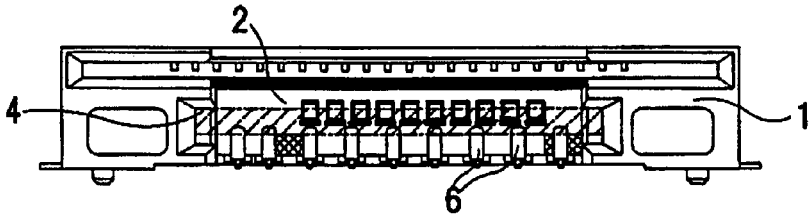
Prior Art FIG. 11
FIG. 11 is a front view of the conventional IC card connector of FIG. 8 showing the second IC card inserted.
Figure 12:
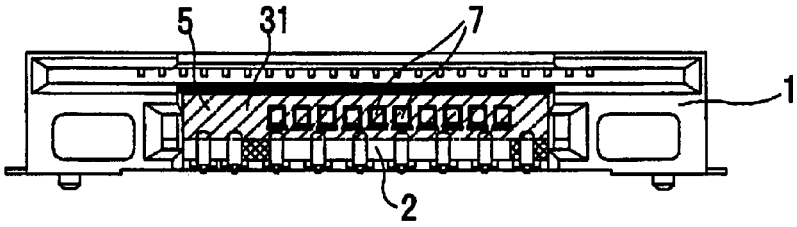
Prior Art FIG. 12
FIG. 12 is a front view of the conventional IC card connector of FIG. 8 showing the third IC card inserted.
Figure 13:
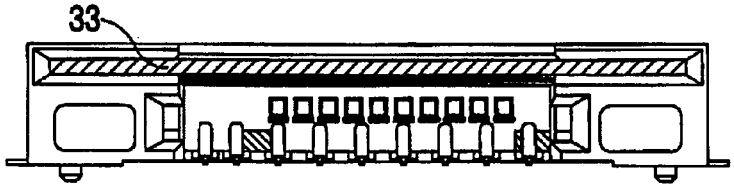
Prior Art FIG. 13
FIG. 13 is a front view of the conventional IC card connector of FIG. 8 showing the fourth IC card inserted.

FIG. 7 shows 2 kinds of the second and the third IC card 27, 28 which are smaller than the first IC card described above in length, width and thickness. The second IC card 27 measures as shown in (a) 32.0 mm in length and 24.0 mm in width, and 9 electrodes 41 are disposed at the tip and a slanted face 29 cut in triangle form at the other corner. Also, as shown in 7(*b*-1) and 7(*c*-1), the thickness is 2.1 mm and corner grooves 30 are formed in each side. The third IC card 28, shown in 7(*a*), measures about the same as the second card 27 in length and width in the front view but contains 7 electrodes, and as shown in 7(*b*-2) and 7(*c*-2) is thin flat shaped with 1.4 mm thickness.

Next, the IC card connector housing of the present invention is described with accompanying FIG. 1–FIG. 5. The IC card connector of the present invention consists of a box shaped connector housing 10 on which disposed are the first insertion slot 11 for inserting the first IC card 34 described above, and the second insertion slot 12 for the second and third IC card 27, 28 in the space of the first insertion slot 11 by partitioning the space with a movable plate 13. More detailed description is given below.

Figure 1:
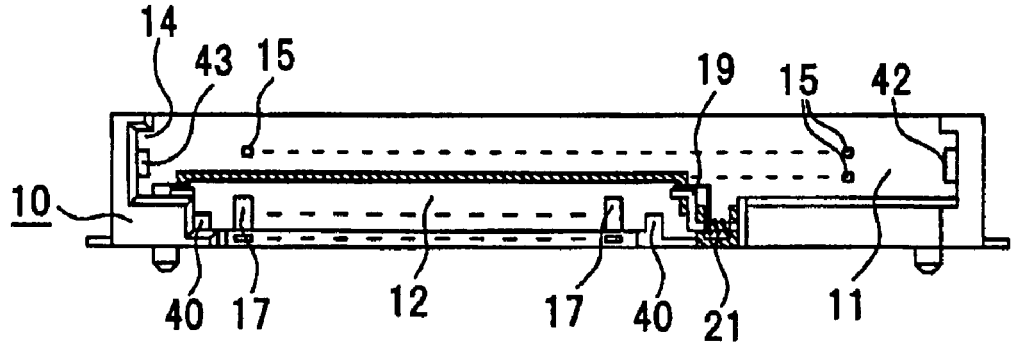
FIG. 1 is a front view of the IC card connector of the present invention showing the composition with one part in cross-section.
Figure 4:
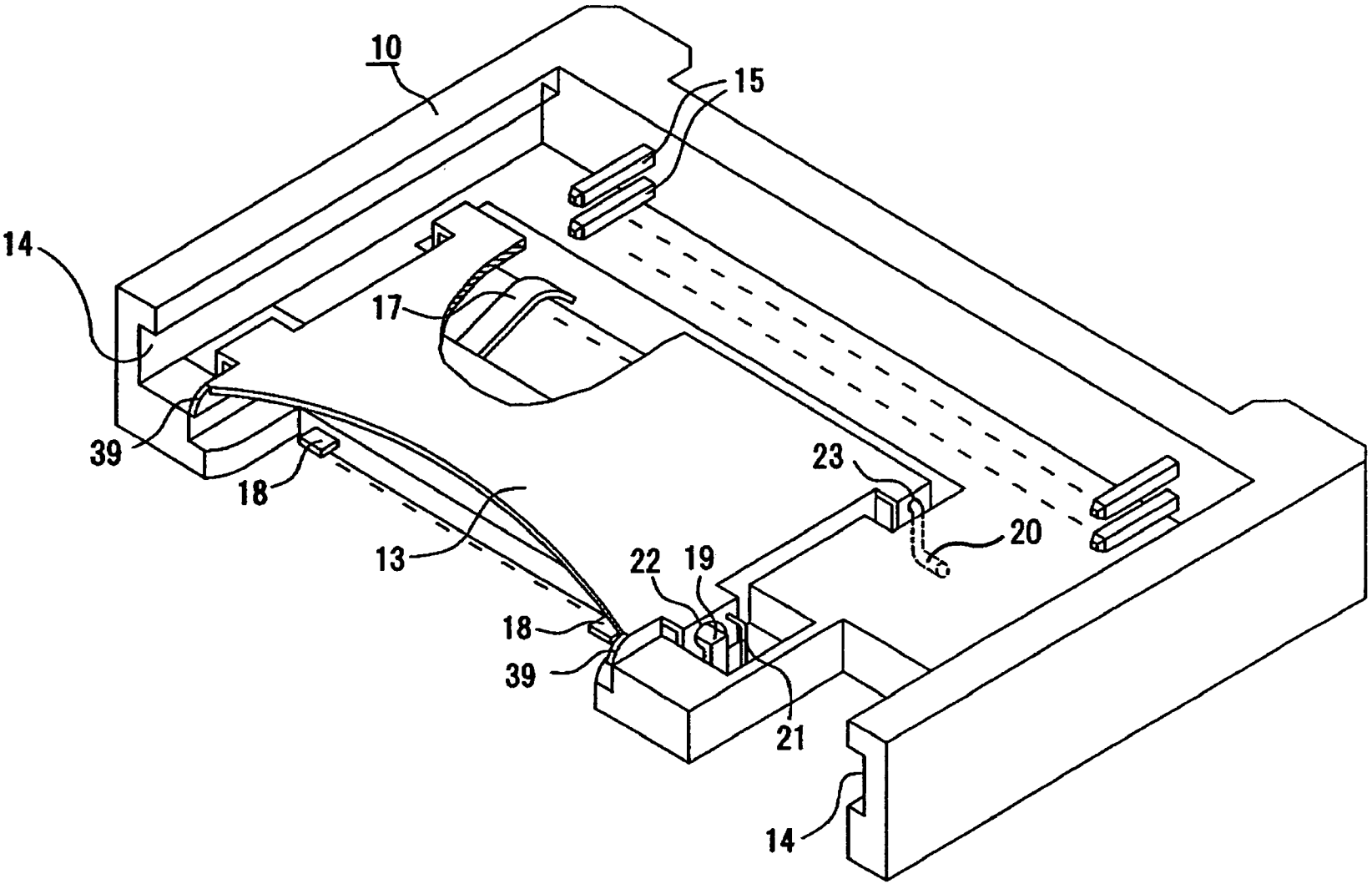
FIG. 4 is a top perspective view of the IC card connector of the present invention showing the composition with one part in cross-section.

As shown in FIG. 1 and FIG. 4, the first insertion slot 11 for the first IC card 34 is disposed on the box shaped connector housing 10, and on both of side faces of the first insertion slot 11, holding grooves 14 for holding the first IC card 34 are formed. Pin terminals 15 are disposed in two rows, top and bottom, 25 each, for a total of 50 pins in the inner part of the first insertion slot 11, and when the first IC card 34 is inserted, these pin terminals are inserted to the pin terminal insertion holes 37 to connect electrically. Further, as shown in FIG. 2, the pin terminals 15 are projected from the back face of the housing 10 to form an external connection terminal part 16 through which an external board is connected.

Figure 2:
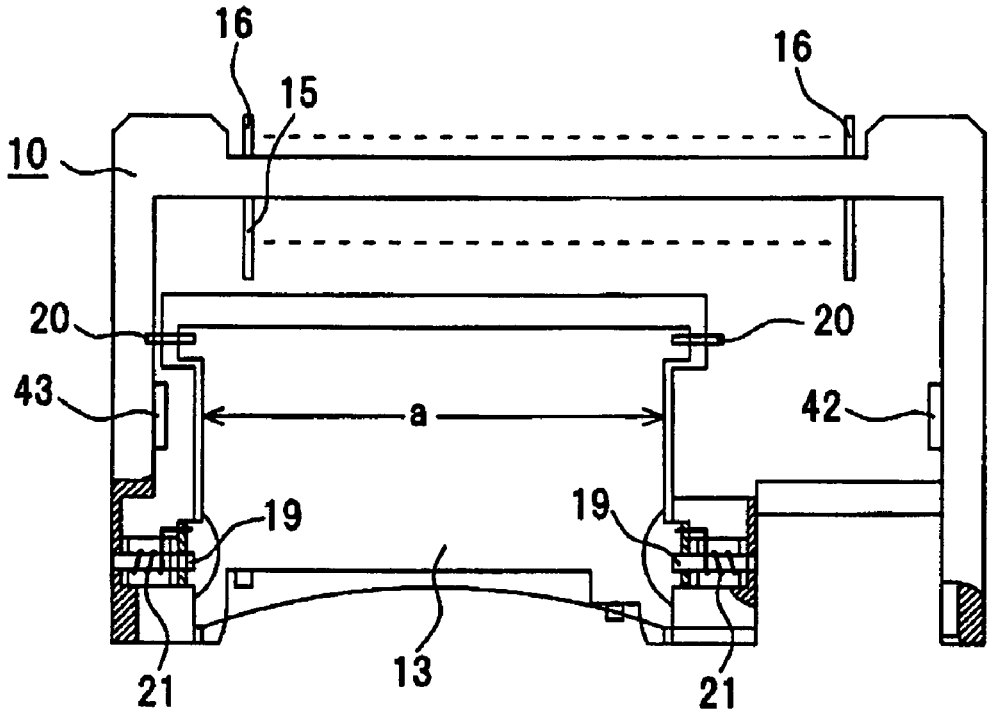
FIG. 2 is a plan view of the IC card connector of the present invention showing the composition with one part in cross-section.

As shown in FIG. 1, FIG. 2 and FIG. 4, the second insertion slot 12 for inserting the second and the third IC card 27, 28 is disposed on the connector housing 10. The second insertion slot 12 is formed in the interior of the insertion space for the first insertion slot 11 described above, and the depth measures up to the front of the aforementioned pin terminals 15 and the width is determined by the size of the second and third IC cards 27, 28, and the bottom face of the housing 10 is formed a little lower to accommodate the width of the cards. The plate, 13 holding the second and third IC cards 27, 28, forms the upper face wall, side face wall and back wall of the second insertion slot 12. Plate 13 is fixed to the housing 10 by hinges 19 at both side faces near the insertion slot as well as by hinges 20 at both side faces of the interior of the insertion slot.

Figure 5:
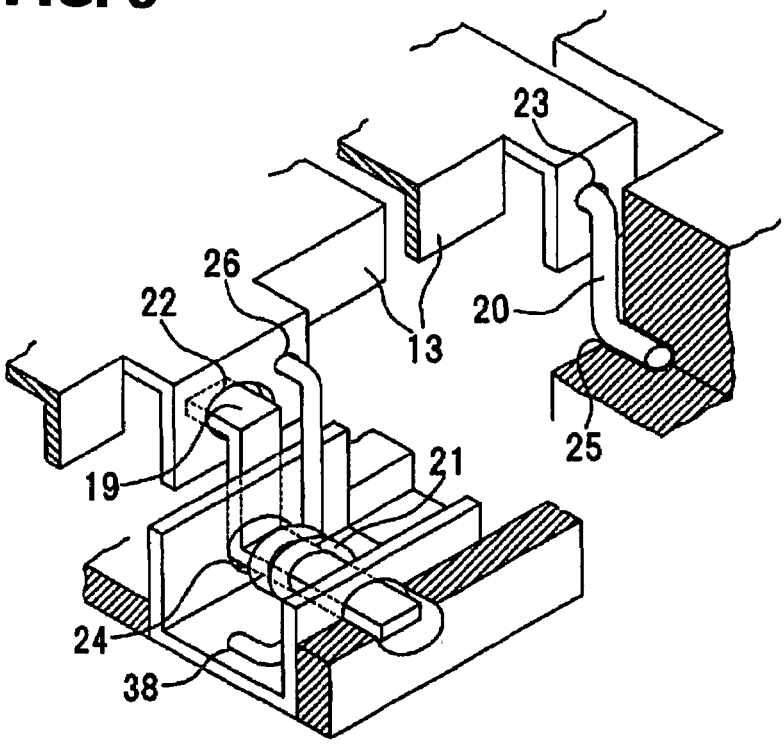
FIG. 5 is a side perspective view showing the connecting part between the plate and the housing in the IC card connector of the present invention.

The mechanism of the plate 13 is described in more detail using FIG. 4 and FIG. 5. As described above, the plate 13 is fixed at 2 places per each hinge 19 and 20, and the both ends of these hinges 19 and 20 are bent at 90 deg in opposite directions as shown in FIGS. 4 and 5. At the near side of the insertion slot, the one end of the hinge 19 is inserted to a hinge insertion hole 22 of the plate 13 and at the same time the other end is inserted to a hinge insertion hole 24 of the housing 10, and at the interior of the insertion slot, the one end of the hinge 20 is inserted to the hinge insertion hole 23 of the plate 13, and at the same time, the other end is inserted to the hinge insertion hole 25 of the housing 10. Since these insertion holes are formed a little larger than the diameter of the hinges, the hinges can turn freely at each insertion hole. In this condition, the entire plate 13 is composed to sink to the bottom face of the housing 10 using the hinge insertion slots of both sides 24 and 25 as fulcra and the distance from the fulcrum to the hinge insertion hole 22 and hinge insertion hole 23 as a radius of gyration. As shown in FIGS. 2 and 5, torsion springs 21 is attached to the hinge 19 described above providing restoring force against the sinking of the plate, and the one end of the torsion spring 21 is fixed into a torsion spring insertion part 26 of the plate 13 and the other end is fixed into a torsion spring insertion part 38 at the bottom face of the housing 10. By these composition, the sinking of the plate 13 to the bottom face of the housing 10 makes the torsion spring 21 accumulate the restoring force.

Inside of the insertion slot 12, in which the insertion space is formed, 9 contacts 17 are disposed for common use for the similar shaped second IC card 27 and third IC card 28, and the contact parts, which are tips of the contacts 17 bent like a hook, are projected from around the center of the bottom face of the housing 10 toward the direction of the interior aslant. At the base end of the contact 17, there are external connection terminals 18, which are faced to the lower face of the front of the housing 10 and connected to the printed circuit board and the like.

The action of the IC card connector of the present invention is described. First, the case of using the second and the third IC card 27, 28 is described referring to FIG. 1–FIG. 4. When the second IC card 27 or the third IC card 28 are used, the card, while the electrodes 41 face down, is inserted to the second insertion slot 12 by fitting the corner grooves 30 of both side of the card to the corner groove 40 in the second insertion slot 12. As shown in FIG. 2, the width of the (a) part of the plate 13 is formed in the size of the width of the second and the third IC card 27, 28 and the height of the plate 13 is optimized so that the card does not move in the vertical direction. Thus the card can be fixed from 4 directions and stabilized. Once the card is inserted to the back, the electrode 41 and the contact 17 make contact making the activities of reading and writing data possible.

Figure 3:
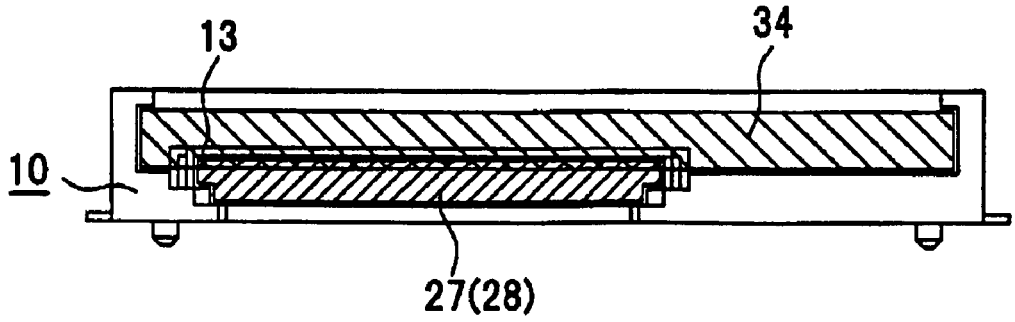
FIG. 3 is a schematic diagram showing insertion spaces for the first second and third IC card in the IC card connector of the present invention.

When the second IC card 27 or the third IC card 28 is inserted, the plate 13 protrudes to the inside of the first insertion slot 11 as shown in FIG. 3, and thus in this condition, the first IC card 34 can not be inserted.

Next, the case of using the first IC card is described referring to FIG. 1–FIG. 4. The first IC card 34 is inserted to the first inserting slot 11 by fitting the both end of the card to the holding groove 14 and to the direction of the side of the pin terminal hole 37. As shown in FIG. 1 and FIG. 3, since the plate 13 is protruded in the insertion space for the first IC card 34 in the first insertion slot 11, the first IC card 34 and the plate 13 make contact. However, as shown in FIG. 4, the both edge parts of the plate 13 where the first IC card 34 makes contact at first are formed into tapered faces 39, and thus when the first IC card 34 is inserted, it slides slowly along the tapered face 39 without catching, and the entire plate 13 is sinking toward the bottom of the housing 10 around the fulcra of the hinge insertion slots of both sides 24 and 25 with a radius of gyration of the distance from the fulcrum to the hinge insertion hole 22 and hinge insertion hole 23. By continuing the insertion, the entire plate 13 is completely sunk to the bottom of the housing 10, and the part of the plate 13 protruded into the space of the first insertion slot 11 is now hidden in the housing 10 and no longer a hindrance to the insertion of the first IC card 34. After inserting the first IC card 34 completely, the pin terminal 15 of the housing 10 is inserted to the pin terminal insertion hole 37 making the activities of reading and writing data possible.

Thus, when the first IC card 34 is inserted completely, there is almost no space in the second insertion slot 12 due to the sinking of the plate 13, and the second IC card 27 or the third IC card 28 cannot be inserted. The sinking of the plate 13 also hides the contact 17 in the second insertion slot 12, and thus there is little chance of damaging the contact 17 for the second and third IC card 27, 28 by the insertion of the first IC card 34.

To prevent the insertion error of the first IC card 34, projections 42, 43 for insertion error prevention are disposed inside the holding groove 14 as shown in FIG. 1 and FIG. 2. These projections 42, 43 for insertion error prevention are formed to fit the side grooves 35, 36 of the IC card 34 as shown in FIG. 6 when inserted in proper direction. As seen in FIG. 6, the width of the grooves 35, 36 differs, and the groove 36 is formed wider, and accordingly the corresponding projections 42, 43 for insertion error prevention are also formed in different width. Thus if the card is inserted upside down in error, the wider projections 42 for insertion error prevention does not fit to the narrower groove 35 preventing further insertion of the card. Inserting the card in wrong direction can also be prevented by these projections 42, 43 for insertion error prevention.

Thus, according to the IC card connector of the present invention, in the insertion space for the one IC card, another insertion space can be secured for the other IC card, which is narrower in width, lower in height and in which the contact part is disposed near the insertion slot, and therefore the arrangements in the complex connector for IC cards may be made more freely than the conventional connector. The embodiment above is described using the first IC card 34, and the second and third IC card 27, 28, but the combination is not limited to that in the embodiment, and other combinations of various IC cards may be used, as long as, in the space for the one IC card, the space for the other IC card can be secured using a plate.

The present invention is described as the IC card connector, in which in the space for the one IC card, the space for the other IC card is secured, but this composition may also be applied to a relation between a normal plug and a connector. In this case, a connector for two kinds of plugs may be composed by disposing an insertion space for a smaller sized plug in the connector for inserting a bigger sized plug by making a partition with a plate.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An IC card connector in which a first and a second IC card are inserted into an insertion slot of a common connector housing so that electrodes of said IC card are connected to contacts in said insertion slot, comprising:

a first IC card insertion slot for said first IC card having a first IC card insertion space;

a second IC card insertion slot for said second IC card that is narrower than said first IC card, said second IC card insertion slot having a second IC card insertion space, one end along a height axis of said second IC card insertion space being positioned in said first IC card insertion slot, and said second IC card insertion space sharing at least a section of said first IC card insertion space;

a plate disposed to partition said shared section with said first IC card as said second IC card insertion space; and includes a mechanism for clearing said first IC card insertion space by retracting from said first IC card insertion space when said first IC card is inserted without said second IC card being inserted.

2. An IC card connector according to claim 1, wherein said plate comprises a restoring force mechanism to return said plate from a position retracted from said first IC card insertion space to a position for partitioning said second IC card insertion space when said first IC card is removed.

3. An IC card connector according to claim 1, wherein said plate further comprises:

a hinge securing said plate to said connector housing, wherein said plate can sink while sliding back in an insertion direction; and a torsion spring mounted on said hinge wherein, when said entire plate sinks down due to insertion of said first IC card, a restorative force is stored by said torsion spring, to restore said plate to an original position partitioning said second IC card insertion space when said first IC card has been removed.

4. An IC card connector according to claim 3, wherein the plate comprises force hinges disposed at four separate positions.

5. An IC card connector according to claim 2, wherein the restoring force mechanism is a torsion spring.

* * * * *

UNITED STATES PATENT AND TRADEMARK OFFICE

CERTIFICATE OF CORRECTION

PATENT NO. : 7,104,802 B1
APPLICATION NO. : 11/251498
DATED : September 12, 2006
INVENTOR(S) : Shinya Okumura et al.

It is certified that error appears in the above-identified patent and that said Letters Patent is hereby corrected as shown below:

In the Cover Page:

Delete "SMK Corporation, Tokyo" and insert -- SMK Corporation, Tokyo, Japan--

Signed and Sealed this

Eighth Day of May, 2007

JON W. DUDAS
*Director of the United States Patent and Trademark Office*